United States Patent [19]

Madan et al.

[11] Patent Number: 4,982,844

[45] Date of Patent: Jan. 8, 1991

[54] BAKERY BASKET

[75] Inventors: Michael K. Madan, Berkeley Heights; Vinod Malhotra, Piscataway, both of N.J.; William Loh, Dalton, Mass.

[73] Assignee: MP Acquisition Corp., Cranford, N.J.

[21] Appl. No.: 545,866

[22] Filed: Jun. 29, 1990

[51] Int. Cl.[5] ..... B65D 21/06

[52] U.S. Cl. ..... 206/506; 206/507

[58] Field of Search ..... 206/506, 505, 507

[56] References Cited

U.S. PATENT DOCUMENTS

| | | | |
|---|---|---|---|
| 3,027,045 | 3/1962 | Wilson | 206/505 |
| 3,379,339 | 4/1968 | Asenbauer | 206/506 |
| 3,392,875 | 7/1968 | Bockenstette | 220/97 |
| 4,109,791 | 8/1978 | Clipson et al. | 206/806 |
| 4,334,616 | 6/1982 | Wilson | 206/505 |
| 4,391,369 | 7/1983 | Stahl et al. | 206/506 |
| 4,423,813 | 1/1984 | Kreeger et al. | 206/506 |
| 4,440,302 | 4/1984 | Ehrman et al. | 206/506 |
| 4,466,541 | 8/1984 | Tabler et al. | 206/506 |
| 4,573,577 | 3/1986 | Miller | 206/506 |
| 4,643,310 | 2/1987 | Deaton et al. | 206/506 |
| 4,770,300 | 9/1988 | Klein | 206/506 |

*Primary Examiner*—George F. Lowrance

*Attorney, Agent, or Firm*—Webb, Burden, Ziesenheim & Webb

[57] ABSTRACT

A bakery basket includes a bottom, opposed side walls and a back wall joined together to form an upwardly open basket body. The side walls include a plurality of vertical support towers which are formed of an outwardly directed projection which defines a hollow opening on the interior of the basket. A slidable bail is positioned within the side walls on a horizontal support ledge therein. Each slidable bail includes one or more support lugs, such as an upper support lug and a lower support lug, and open areas adjacent each hollow opening in the side walls. Slidable bails are moveable in a variety of positions, including positioning the open areas aligned with the hollow openings, positioning the lower support lugs aligned with the hollow openings and positioning the upper support lugs aligned with the hollow openings. In this manner, the baskets may be stacked at one or more height levels and may also be nested together, depending on the position of the slidable bails.

23 Claims, 5 Drawing Sheets

BAKERY BASKET

BACKGROUND OF THE INVENTION

1. Field of the Invention

This invention relates to bakery baskets and, more particularly, to bakery baskets which can be nested together as well as stacked at different heights.

2. Description of the Prior Art

The use of large bakery baskets for transporting bakery products to retail stores is well known. These baskets are typically rectangular in configuration and include a perforated bottom, opposed side walls, a back wall and often a shorter front wall. The baskets are either immediately emptied of their contents or are used as display stands during the sale of the products. In any event, the empty baskets are eventually returned to the manufacturer. In order to save space during the return trip, it is desirable for the baskets to be nested as closely as possible. In addition, the baskets should securely stack on top of one another when they are transporting the baked products. Moreover, it is desirable to provide different stack heights for the baskets since the bakery products transported therein often come in different thicknesses or heights.

A variety of bakery baskets which can be stacked at different heights, as well as nested when empty, are known in the art. See, for example, U.S. Pat. Nos. 3,392,875, 4,109,791, 4,334,616, 4,391,369, 4,423,813, 4,466,541, 4,573,577, 4,643,310 and 4,770,300. While the bakery baskets shown in these patents do provide for nesting and stacking at different heights, they suffer from one or more defects which detract from their usefulness. For example, many of the arrangements include hinged or sliding bails which are exposed to other baskets and can become easily broken during use. In addition, many of the arrangements are difficult and cumbersome to use. Furthermore, many of the arrangements require that the baskets be rotated by 90° or 180° with respect to each other to obtain one of the stacking heights or the nesting position.

A bakery basket which overcomes many of the disadvantages of the prior art is shown in U.S. Pat. No. 4,440,302 to Ehrman et al. In the basket disclosed in the Ehrman patent, each end wall 16 includes a pair of stepped towers 20 which project inwardly and form three slots C1–C3 with corresponding stop surfaces N1–N3. A pair of stacking lugs 30 are supported on the upper portion of each end wall and project inwardly therefrom. The lugs are connected by thinner bosses to slidable runners 42 which are, in turn, connected to each other by a rack 43 and pinion 50 mechanism. In this manner, movement of one of the lugs will cause the other lug to move correspondingly. The lugs have a flat upper surface and are moved to various locations along the basket end walls to contact different stop surfaces on the stepped towers of an adjacent basket.

While the bakery basket disclosed in the Ehrman patent does provide for nesting and stacking at various levels, the particular structure employed has many disadvantages. In particular, the stacking lugs extend inwardly from the end walls and are totally exposed, subjecting them to easy breakage. The stacking lugs, which support the weight of an upper basket, are not carried by any solid support surface but are only carried by thinner bosses connected to the runners. In addition, the construction, using the rack and pinion mechanism, is quite complicated and is subject to breakage.

Accordingly, it is an object of the present invention to provide a bakery basket which can be nested as well as stacked in multiple height levels. Furthermore, it is an object to provide such a bakery basket which utilizes a sliding bail, but which is not subject to easy breakage and can securely support the load of an adjacent basket and transfer the load to the entire side wall structure of the basket. In addition, it is an object to provide such a bakery basket in an arrangement which is inexpensive to manufacture and easy to operate.

SUMMARY OF THE INVENTION

Accordingly, we have invented a bakery basket which includes a bottom, opposed side walls and a back wall joined together to form an upwardly open basket body. A plurality of vertical support towers, preferably three, are provided in each side wall, with each support tower formed of an outwardly directed projection which defines a hollow opening oriented toward an interior of said basket. The hollow openings are configured to receive the support towers of another bakery basket when nested together. The bakery basket also includes a horizontal support ledge within each side wall at an upper portion thereof. A slidable bail is positioned within each of the side walls on the support ledge. Each slidable bail includes contiguous upper support lugs, lower support lugs and open areas adjacent each hollow opening in the side walls. The slidable bails are moveable from a first position, with the upper support lugs of the bails aligned with the hollow openings and contacting the support towers of another bakery basket to provide stacking at a first height, to a second position with the lower support lugs of the bails aligned with the hollow openings and contacting the support towers of another bakery basket to provide stacking at a second, lower height, and to a third position with the open areas of the bails aligned with the hollow openings and permitting nesting with another bakery basket.

Preferably, the bottom of the basket slopes downward to the back wall at about a slope of 3°. The side walls each preferably have an inside wall extending upward from the bottom, a top wall extending horizontally outward from an upper edge of the inside wall and a shorter outside wall extending downward from the outer edge of the top wall and generally parallel to and spaced from the inner wall. The horizontal support ledge is positioned beneath and spaced from the top wall and extends between the inside wall and the outside wall. The top walls may include along their outer edges a raised locator flange which cooperates with one or more outwardly projecting locator tabs on the bottom of the basket.

The bails may each have a locking ridge along a top surface thereof and the top walls of the side walls each include three notches therethrough. The locking ridge engages one of the notches to both hold the bails in a desired position and provide a visual indication of the position of the bails. The bails may also include along an outer wall thereof near a front of the bail a recessed finger hole for moving the bails from one position to the next. The bails may also have an inwardly oriented slide pin on a rear surface of the recessed finger hole which engages a corresponding horizontal groove in the inside wall of the side walls.

The support lugs may each include a raised stabilizer which engages a lower portion of a support tower. Preferably, the support towers and corresponding hollow openings are tapered inward from the top edge of the side walls to the bottom. A lower portion of each support tower may have an outwardly extending lip and each hollow opening has an inwardly oriented flange spaced from and positioned near the bottom. In this manner, the lips will rest on the flanges when the baskets are nested together and prevent lockup of the nested baskets.

DETAILED DESCRIPTION OF THE PREFERRED EMBODIMENT

Figure 1:
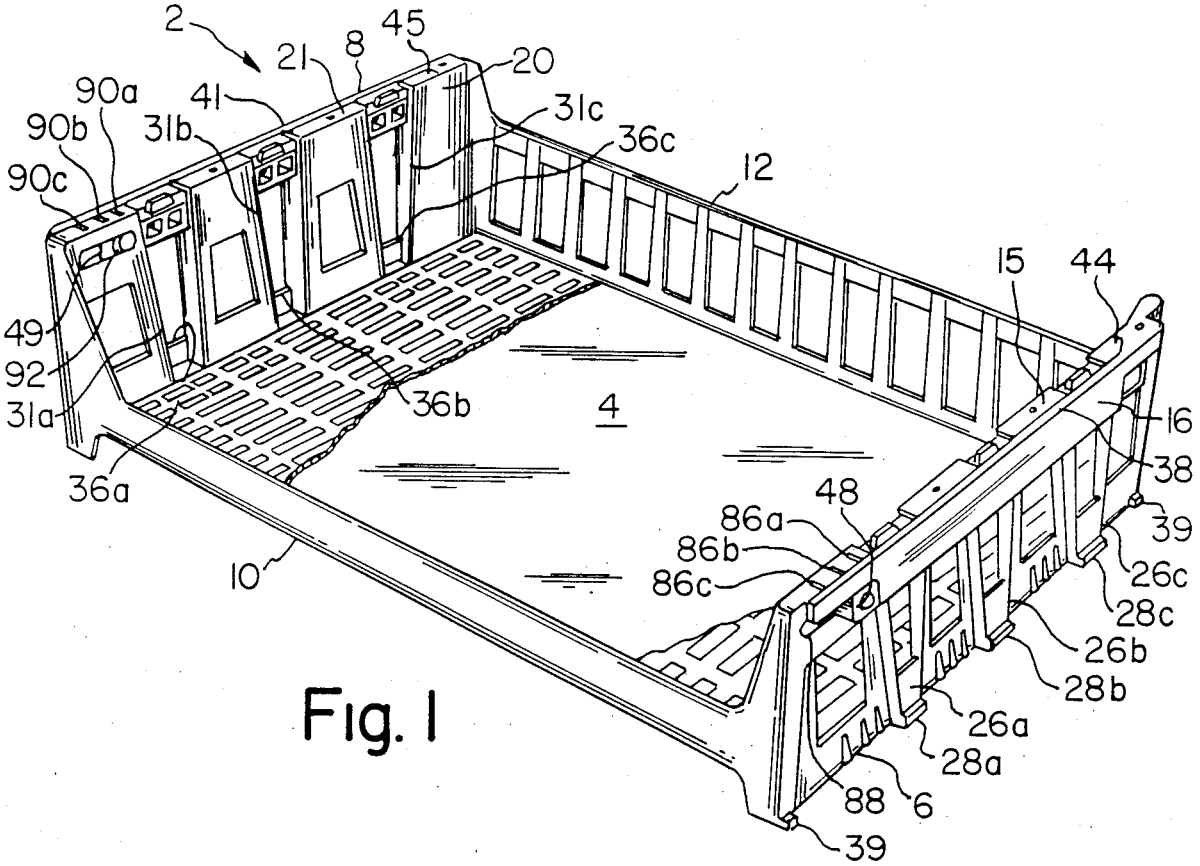
FIG. 1 is a perspective view of a bakery basket in accordance with the present invention.
Figure 4:
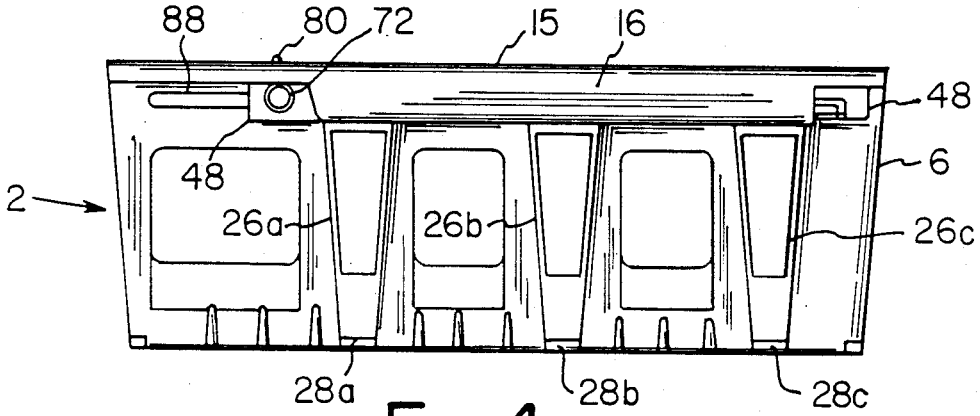
FIG. 4 is an elevational view of the right side of the bakery basket shown in FIG. 1.
Figure 5:
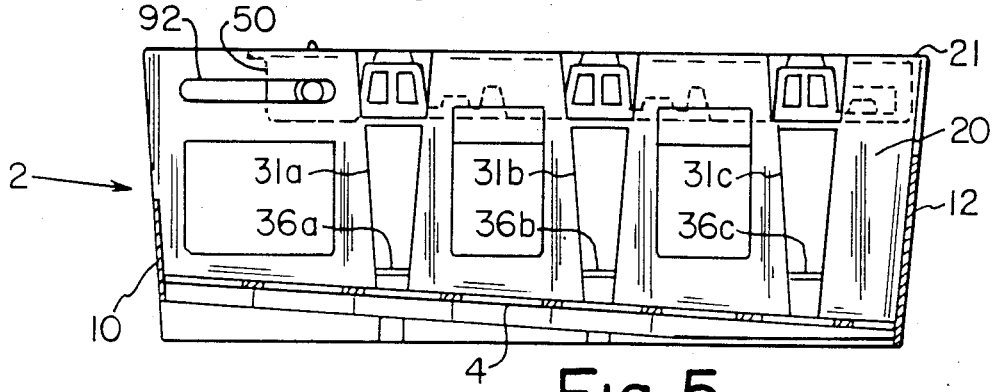
FIG. 5 is a section taken along lines V—V in FIG. 3 with the bails in place.
Figure 2:
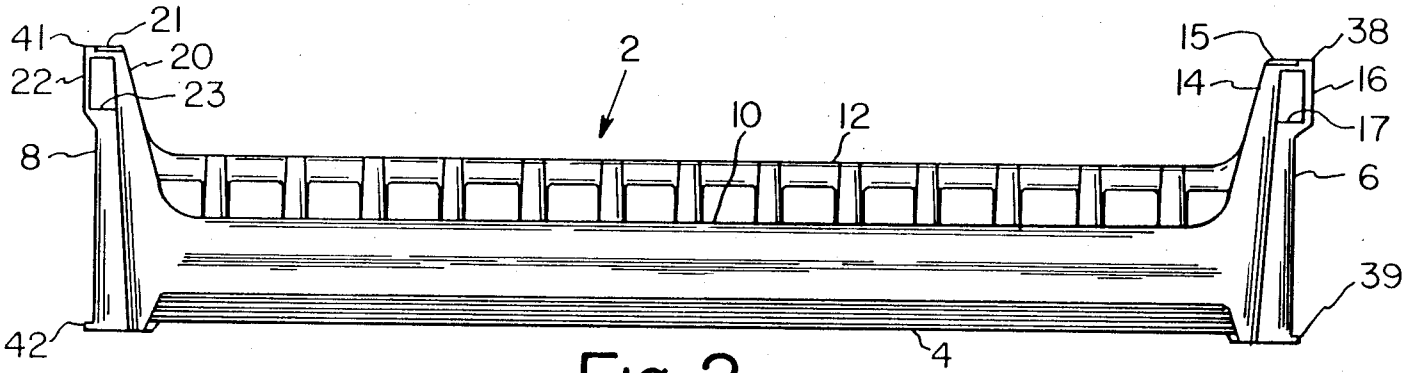
FIG. 2 is a front, elevational view of the bakery basket shown in FIG. 1 with the sliding bails removed.
Figure 6:
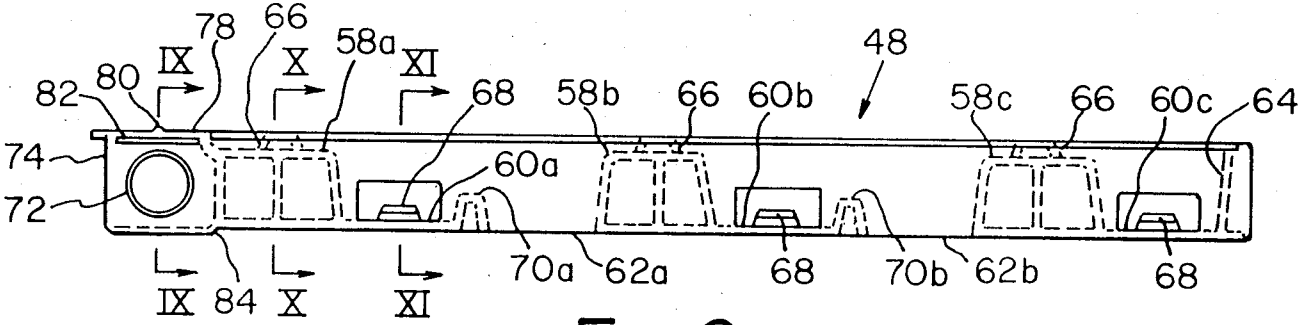
FIG. 6 is an elevational view of one side of a right bail used in the bakery basket shown in FIG. 1.
Figure 7:
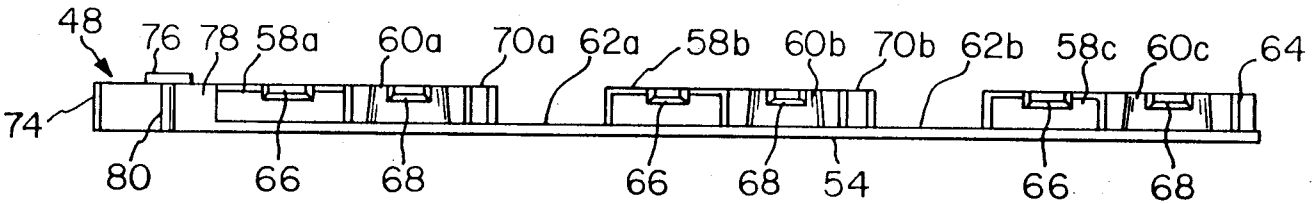
FIG. 7 is a top view of the bail shown in FIG. 6.
Figure 3:
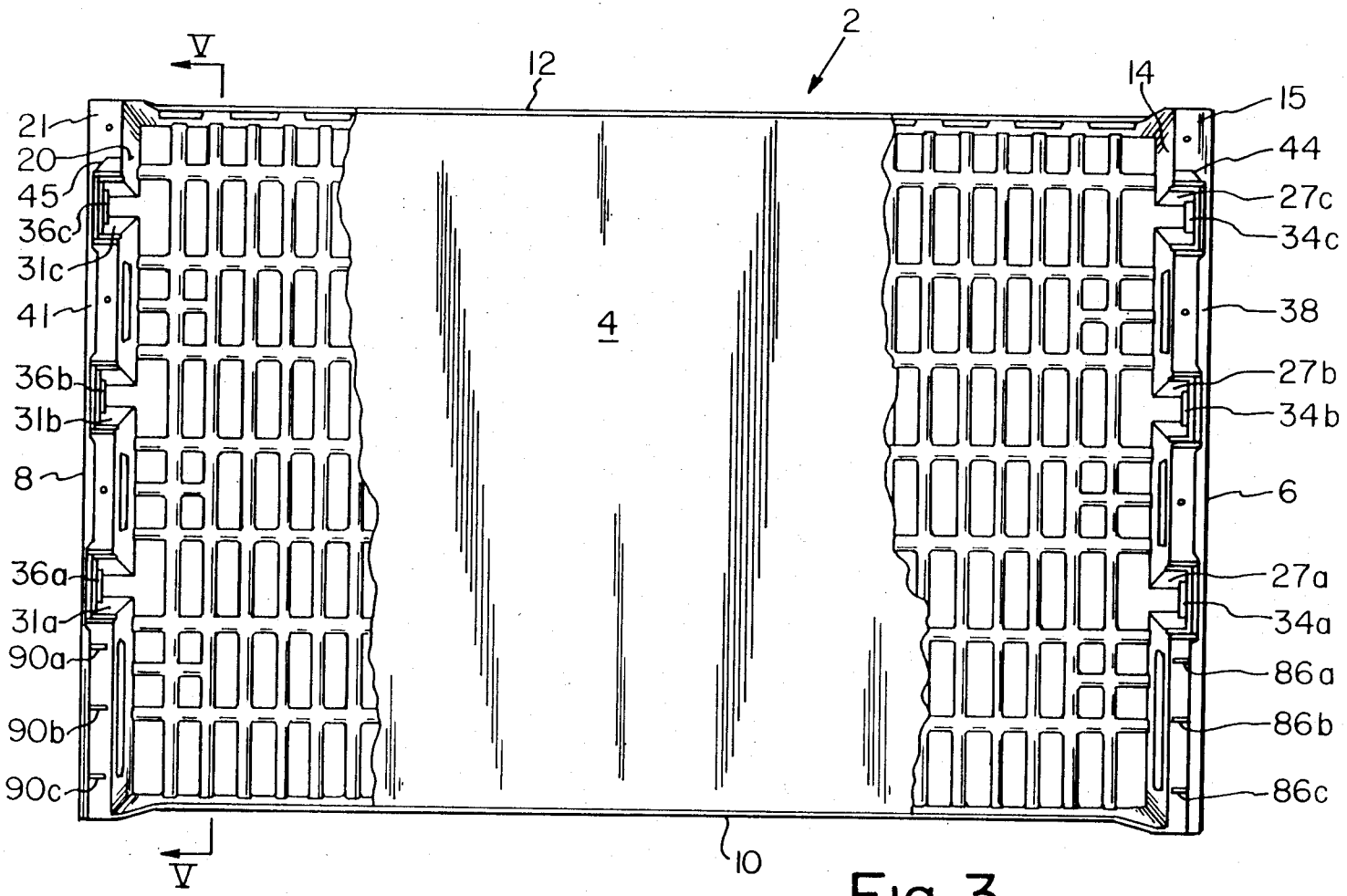
FIG. 3 is a top plan view of the bakery basket shown in FIG. 1 with the bails removed.
Figure 8:
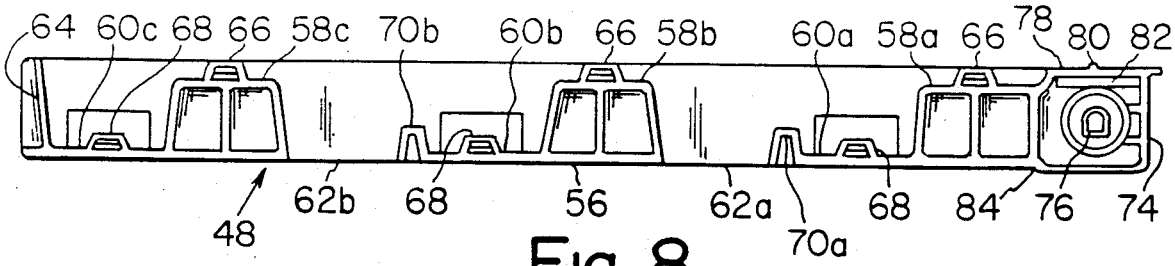
FIG. 8 is an elevational view of the other side of the bail shown in FIG. 6.
Figure 9:
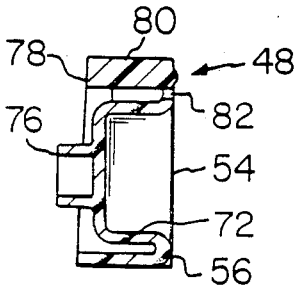
FIG. 9 is a section taken along lines IX—IX in FIG. 6.
Figure 10:
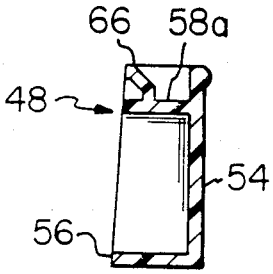
FIG. 10 is a section taken along lines X—X in FIG. 6.
Figure 11:
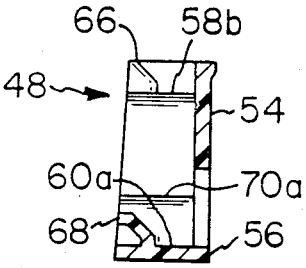
FIG. 11 is a section taken along lines XI—XI in FIG. 6.

A bakery basket 2 in accordance with the present invention is shown in FIGS. 1-5. The basket 2 includes a flat bottom 4, a right side wall 6, a left side wall 8, a front wall 10, and a back wall 12 forming an upwardly open basket body. The side walls 6, 8, front wall 10 and back wall 12 are integrally joined together and extend upwardly from the bottom 4, preferably with an outward inclination from the bottom 4. The bottom 4 is preferably of rectangular configuration and is perforated. In addition, the bottom 4 preferably is inclined with a downward slope of about 3° from the front wall 10 to the back wall 12. Moreover, it is preferred that the back wall 12 have a height which is less than the height of the side walls 6, 8 and that the front wall 10 have a height which is substantially less than that of the back wall 12. The front wall 10 may be eliminated, if desired, to improve access to the interior of the basket 2.

The right side wall 6 is formed of an inside wall 14 which extends upwardly from the bottom 4, a top wall 15 extending horizontally outward from the upper edge of the inside wall 14, and a shorter outside wall 16 extending downwardly from the outer edge of the top wall 15 and generally parallel to and spaced from the inside wall 14. A horizontal support ledge 17 is positioned within the right side wall 6, beneath and spaced from the top wall 15, and extends between the inside wall 14 and the lower edge of the outside wall 16. Similarly, the left side wall 8 includes an inside wall 20, topwall 21, outside wall 22 and horizontal support ledge 23.

A plurality of support towers 26 are formed in the right side wall 6. Each support tower 26 is formed of an outwardly directed projection which defines a hollow opening 27 directed toward the interior of the basket 2. The hollow openings 27 are configured to receive the support towers 26 of another bakery basket when the baskets are positioned together in a nesting arrangement. The support towers 26 and hollow openings 27 are preferably formed with a downward taper so that the bottoms of the support towers 26 and hollow openings 27 are narrower than their tops. As shown in the present embodiment, the right side wall 6 includes three support towers identified as elements **26*a*, 26*b* and 26*c*, with corresponding hollow openings 27*a*, 27*b* and 27*c*. Similarly, the left side wall 8 includes three support towers, which are not visible in the drawings, defining hollow openings 31*a*, 31*b* and 31*c***.

The lower portion of each support tower preferably has an outwardly oriented lip formed integral therewith. As shown, support towers **26*a*, 26*b* and 26*c* in the right side wall 6 have lips 28*a*, 28*b* and 28*c*, respectively, thereon. Similar lips are formed on the support towers in the left side wall 8. When the bakery baskets 2 are positioned in the nesting arrangement, the lips on the support towers contact and rest on an inwardly oriented flange in the hollow openings. This flange is spaced from and positioned near the bottom 4 of the basket 2 at an appropriate height to keep the nested baskets from being wedged too tightly together. Flanges 34*a*, 34*b* and 34*c* are provided in hollow openings 27*a*, 27*b* and 27*c* and flanges 36*a*, 36*b* and 36*c* are provided in hollow openings 31*a*, 31*b* and 31*c***, respectively.

The top wall 15 of the right side wall 6 includes along its outer edge a raised locator flange 38 which cooperates with one or more outwardly projecting locator tabs 39 on the right side wall 6 of the basket 2. Similarly, the top wall 21 of the left side wall 8 includes a raised locator flange 41 which cooperates with one or more outwardly projecting tabs 42 on the left side wall 8 of the basket 2. The locator flanges 38, 41 form a solid stop 44, 45, respectively, near the back wall 12 of the basket 2. These flanges 38, 41, stops 44, 45 and cooperating tabs 39, 42, function to properly orient and align one basket stacked on top of another basket and is particularly useful in blind stacking of baskets.

A slidable bail is positioned within each side wall and is carried by the support ledges therein. The bails are completely surrounded by and held in place by the inside wall, top wall, outside wall and support ledge in each side wall. Specifically, a right bail 48 is positioned within the right side wall 6 on support ledge 17 and surrounded by inside wall 14, top wall 15 and outside wall 16. Similarly, a left bail 50 is positioned within the left side wall 8 on support ledge 23 and surrounded by inside wall 20, top wall 21 and outside wall 22.

The right bail 34 is shown in detail in FIGS. 6-11. The left bail 50 is a mirror image of the right bail 48 and is, therefore, not separately shown in detail in the figures. The right bail 48 is an elongated member which includes a vertical outer wall 54 and a horizontal bottom 56 attached thereto. The bottom 56 is positioned at about a 90° angle to the outer wall 54 to form an L-shaped, cross-sectional structure. The right bail 48 includes upper support lugs 58, lower support lugs 60, and open areas 62 contiguous with one another. Pairs of upper and lower support lugs 58, 60 are provided for each hollow opening 27 in the right side wall 6. Therefore, the right bail 48 shown in FIGS. 6–10 includes an upper support lug 58*a*, lower support lug 60*a* and open area 62*a* adjacent hollow opening 27*a* in the right side wall 6. Similarly, an upper support lug 58*b*, lower support lug 60*b* and open area 62*b* are provided adjacent hollow opening 27*b*. Finally, an upper support lug 58*c* and lower support lug 60*c* are provided adjacent hollow opening 27*c*. The right bail 48 need not include a separate open area therein adjacent hollow opening 27*c* since an open area is formed by definition beyond the rear wall 64 at the back end of the right bail 48.

Each upper support lug 58 includes a raised stabilizer 66 thereon and each lower support lug 60 includes a raised stabilizer 68 thereon. A raised stop 70*a* can be included between lower support lug 60*a* and upper support lug 58*b* to further define open area 62*a*. Similarly, a raised stop 70*b* can be provided between lower support lug 60*b* and upper support lug 58*c* to define open area 62*b*. It can be seen in the drawings that the lower support lugs 60 are formed merely by the area of the horizontal bottom 56 between the upper support lugs 58 and the raised stops 70 or between upper support lug 58*c* and the rear wall 64.

A recessed finger hole 72 is provided in the outer vertical wall 54 of the right bail 48 in the area between a front wall 74 thereof and the beginning of upper support lug 58*a*. A slide pin 76 is formed integral with a rear surface of the recessed finger hole 72 and is oriented toward the interior of the bakery basket 2. The right bail 48 also includes a top wall 78 in the area between the front wall 74 and upper support lug 58*a*. The upper surface of the top wall 78 includes a locking ridge 80 extending thereacross. A spacing 82 is formed between the vertical outer wall 54 and the top wall 78 beneath the locking ridge 80 and provides for flexing of the top wall 78. The horizontal bottom 56 of the right bail 48 is slightly lower in the area between the front wall 78 and upper support lug 58*a* to form an offset 84 therebetween.

Three spaced notches 86*a*, 86*b* and 86*c* are provided through the top wall 15 of the right side wall 6 between the front wall 10 and the first hollow opening 27*a* therein. An elongated, horizontal groove 88 is provided through the inside wall 14 of the right side wall 6, beneath top wall 15, and extends along the area between the front wall 10 and the first hollow opening 27*a*. Similar notches 90*a*, 90*b* and 90*c* and a groove 92 are provided in the left side wall 8.

The right bail 48 is positioned within the right side wall 6 on support ledge 17 and surrounded by inside wall 14, top wall 15 and outside wall 16. The recessed finger hole 72 is oriented outward and is accessible since top wall 15 stops sufficiently short of the front wall 10. The slide pin 76 engages groove 88 and the locking ridge 80 engages one of notches 86*a*, 86*b* and 86*c*, depending on the position of the right bail 48. The left bail 50 is similarly positioned within the left side wall 8 and engages groove 92 and one of notches 90*a*, 90*b* and 90*c*.

The bails are moved in a horizontal manner along the support ledges in order to completely uncover the hollow openings in the side walls, or to cover up the hollow openings with a lower support lug, or to cover up the hollow openings with an upper support lug. In this manner, the baskets can be either nested together or can be stacked at one of two different stacking heights.

Figure 12:
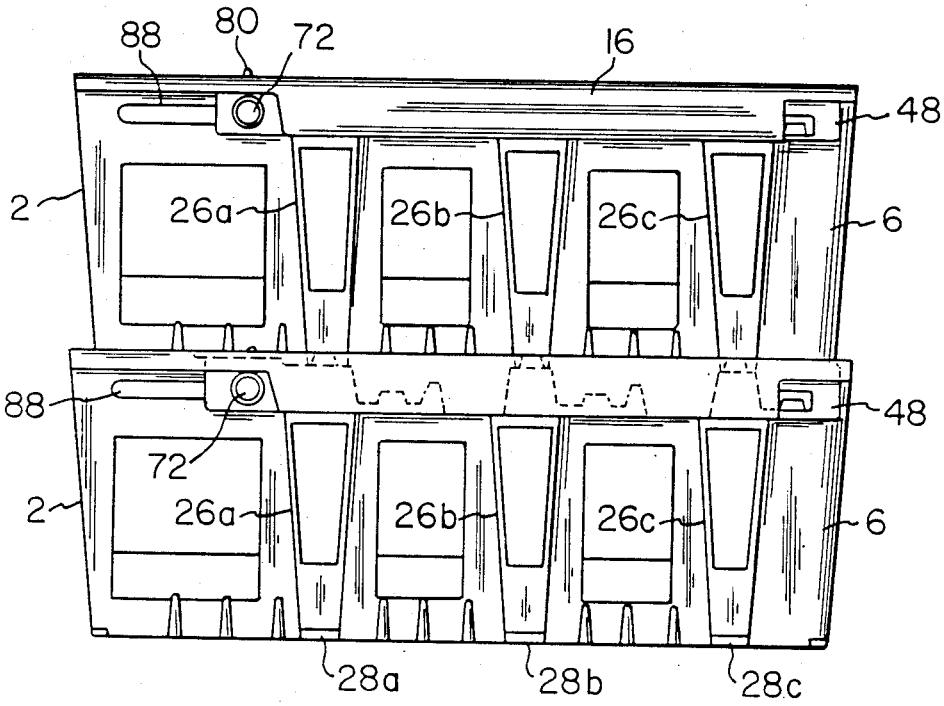
FIG. 12 is an elevational view of the right side of a pair of bakery baskets shown in FIG. 1 stacked at the higher stacking height.

Referring now to FIG. 12, it is seen that the right bail 48 in the lower basket is moved furthest toward the back wall 12 with the locking ridge 80 engaged with notch 86*a*. The offset 84 will contact support ledge 17 and ensure that the right bail 48 travels no further rearward. In this arrangement, the upper support lugs 58 are positioned over hollow openings 27 in the right side wall 6. The left bail 50 would be similarly positioned at notch 90*c*. The support towers 26 of an upper basket are positioned on the upper support lugs 58 of the lower basket, with raised stabilizers 66 extending into the hollow support towers 26. This provides for stacking of the baskets at a higher level, typically 6".

Figure 13:
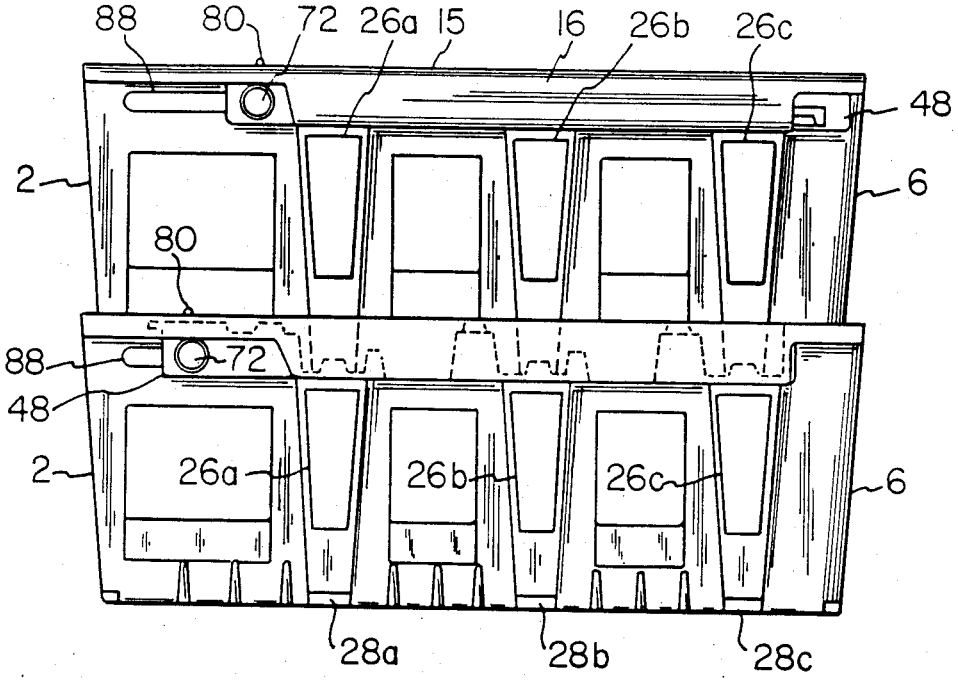
FIG. 13 is an elevational view similar to FIG. 12 showing the bakery baskets stacked at the lower stacking height.

By grasping the finger hole 72 and moving the right bail 48 one notch toward the front wall 10, the locking ridge 80 will engage notch 86*b* and the lower support lugs 60 are positioned over the hollow openings 27 in the right side wall 6. This is shown in the lower basket in FIG. 13. The left bail 50 is also moved to notch 90*b*. The support towers 26 of an upper basket are positioned on the lower support lugs 58 of the lower basket, with raised stabilizers 68 extending into the hollow support towers 26. This provides for stacking of the baskets at a lower level, typically 5".

Figure 14:
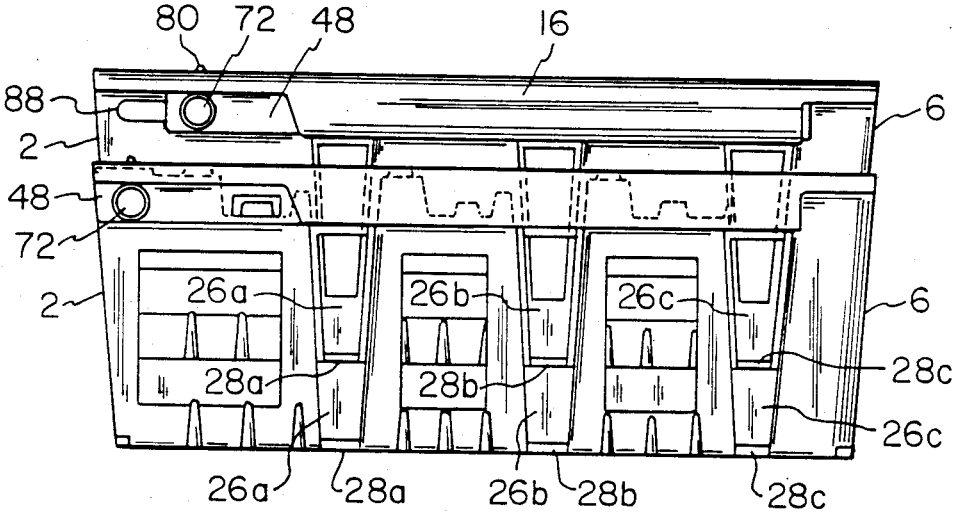
FIG. 14 is an elevational view similar to FIGS. 12 and 13 showing the bakery baskets in the nested position.

By moving the right bail 48 one more notch toward the front wall 10, the locking ridge 80 will engage notch 86*c* and the open areas 62 and the open area beyond the rear wall 64 are positioned over the hollow openings 27 in the right side wall 6. This is shown in the lower basket in FIG. 14. The left bail is also moved to notch 90*c*. This arrangement permits the support towers 26 of an upper basket to completely nest within the hollow openings 27 of the lower basket, with the lips 28 on the support towers 26 of the upper basket engaging the flanges 34 in the hollow openings 27 of the lower basket.

While the arrangement above is shown in conjunction with one open area and two support lugs at different levels, it is to be appreciated that additional support lugs at different heights can be included, as well as eliminating one of the support lugs. In addition, at least two support towers and corresponding openings are needed in each end wall. The arrangement shown in the figures includes three support towers in each end wall, which is believed to be an ideal arrangement.

The bail is totally supported by ledges within the side walls of the basket which transfer static loads to the sides and then to the bottom of the basket. In addition, the bail is captured within the inside and outside walls of the side walls of the basket. This ensures good protection of the bail. A simple and easy motion is all that is required to change the stacking heights of the baskets or to move the baskets to the nesting arrangement. The separate bails can be easily removed from the basket and replaced if one does become damaged during use. It is preferred that the bail and the baskets be made of a strong, yet lightweight thermoplastic material, such as Noryl 4608 plastic manufactured by General Electric Plastics. It is desired that the bail be made of a different color than the baskets so that the location of the locking ridge in the notches is readily apparent. In this way, the available stacking position can be determined by visually inspecting the top of the basket.

Having described above the presently preferred embodiment of this invention, it is to be understood that it may be otherwise embodied within the scope of the appended claims.

We claim:

1. A bakery basket comprising:

(a) a bottom, opposed side walls and a back wall joined together to form an upwardly open basket body;

(b) a plurality of vertical support towers in each side wall, with each support tower formed of an outwardly directed projection which defines a hollow opening directed toward an interior of said basket, with said hollow openings configured to receive the support towers of another bakery basket when nested together;

(c) a horizontal support ledge within each side wall at an upper portion thereof; and (d) a slidable bail positioned within each of said side walls and on said support ledge, with each slidable bail including contiguous upper support lugs, lower support lugs and open areas adjacent each hollow opening in said side walls, with the slidable bails moveable from a first position, with the upper support lugs of the bails aligned with said hollow openings and receiving the support towers of another bakery basket to provide stacking at a first height, to a second position with the lower support lugs of the bails aligned with said hollow openings and contacting the support towers of another bakery basket to provide stacking at a second, lower height, and to a third position with the open areas of the bails aligned with said hollow openings and permitting nesting with another bakery basket.

2. The bakery basket of claim 1 wherein said bottom slopes downward toward said back wall.

3. The bakery basket of claim 2 wherein said bottom has a slope of about 3°.

4. The bakery basket of claim 1 wherein said side walls each have an inside wall extending upward from the bottom, a top wall extending horizontally outward from an upper edge of the inside wall and a shorter outside wall extending downward from the outer edge of the top wall and generally parallel to and spaced from the inside wall, with said horizontal support ledges positioned beneath and spaced from the top wall and extending between the inside wall and the outside wall.

5. The bakery basket of claim 4 wherein said top walls include along their outer edges a raised locator flange which cooperates with one or more outwardly projecting locator tabs on the bottom of said basket.

6. The bakery basket of claim 4 wherein said bails each ave a locking ridge along a top surface thereof at a front surface, and said top walls of said side walls each including three notches therethrough, with said locking ridges engaging one of said notches and both holding said bails in a desired position and providing a visual indication of the position of the bails.

7. The bakery basket of claim 4 wherein the bails each have, along an outer wall thereof and near a front of said bail, a recessed finger hole for moving the bails from one position to the next.

8. The bakery basket of claim 7 wherein said bails each have an inwardly oriented slide pin on a rear surface of said recessed finger hole which engages a corresponding horizontal groove in the inside wall of said side walls.

9. The bakery basket of claim 1 wherein said support lugs each include a raised stabilizer which engages a lower portion of a support tower.

10. The bakery basket of claim 1 wherein said support towers and corresponding hollow openings are tapered inward from a top edge of said side walls to said bottom.

11. The bakery basket of claim 10 including three support towers and corresponding hollow openings in each of said side walls.

12. The bakery basket of claim 1 wherein a lower portion of each of said support towers has an outwardly extending lip and wherein each hollow opening has an inwardly oriented flange spaced from and positioned near said bottom, whereby the lips will rest on said flanges when the baskets are nested together.

13. A bakery basket comprising:

(a) a bottom, opposed side walls and a back wall joined together to form an upwardly open basket body;

(b) at least two vertical support towers in each side wall, with each support tower formed of an outwardly directed projection which defines a hollow opening oriented toward an interior of said basket, with said hollow openings configured to receive the support towers of another bakery basket when nested together;

(c) a horizontal support ledge within each side wall at an upper portion thereof; and (d) a slidable bail positioned within each of said side walls and on said support ledge, with each slidable bail including at least one support lug and an open area adjacent each hollow opening in said side walls, with the slidable bails moveable from a first position, with the support lugs of the bails aligned with said hollow openings and contacting the support towers of another bakery basket to provide stacking at a particular height, to a second position with the open area of the bails aligned with said hollow openings and permitting nesting with another bakery basket.

14. The bakery basket of claim 13 wherein said bottom slopes downward toward said back wall.

15. The bakery basket of claim 14 wherein said bottom has a slope of about 3°.

16. The bakery basket of claim 13 wherein said side walls each have an inside wall extending upward from the bottom, a top wall extending horizontally outward from an upper edge of the inside wall and a shorter outside wall extending downward from the outer edge of the top wall and generally parallel to and spaced from the inside wall, with said horizontal support ledges positioned beneath and spaced from the top wall and extending between the inside wall and the outside wall.

17. The bakery basket of claim 16 wherein said top walls include along their outer edges a raised locator flange which cooperates with one or more outwardly projecting locator tabs on the bottom of said basket.

18. The bakery basket of claim 16 wherein said bails each have a locking ridge along a top surface thereof at a front surface, and said top walls of said side walls each including three notches therethrough, with said locking ridges engaging one of said notches and both holding said bails in a desired position and providing a visual indication of the position of the bails.

19. The bakery basket of claim 16 wherein the bails each have, along an outer wall thereof and near a front of said bail, a recessed finger hole for moving the bails from one position to the next.

20. The bakery basket of claim 19 wherein said bails each have an inwardly oriented slide pin on a rear surface of said recessed finger hole which engages a corresponding horizontal groove in the inside wall of said side walls.

21. The bakery basket of claim 13 wherein said support lugs each include a raised stabilizer which engages a lower portion of each support tower.

22. The bakery basket of claim 13 wherein said support towers and corresponding hollow openings are tapered inward from a top edge of said side walls to said bottom.

23. The bakery basket of claim 13 wherein a lower portion of each of said support towers has an outwardly extending lip and wherein each hollow opening has an inwardly oriented flange spaced from and positioned near said bottom, whereby the lips will rest on said flanges when the baskets are nested together.

* * * * *